US011097330B2

(12) United States Patent
Flehmig et al.

(10) Patent No.: US 11,097,330 B2
(45) Date of Patent: Aug. 24, 2021

(54) METHOD FOR PRODUCING A FORMED COMPONENT HAVING A DIMENSIONALLY ACCURATE WALL REGION

(71) Applicants: ThyssenKrupp Steel Europe AG, Duisburg (DE); thyssenkrupp AG, Essen (DE)

(72) Inventors: Thomas Flehmig, Ratingen (DE); Martin Kibben, Dinslaken (DE); Daniel Nierhoff, Mulheim (DE)

(73) Assignees: THYSSENKRUPP STEEL EUROPE AG, Duisburg (DE); THYSSENKRUPP AG, Essen (DE)

( * ) Notice: Subject to any disclaimer, the term of this patent is extended or adjusted under 35 U.S.C. 154(b) by 181 days.

(21) Appl. No.: 16/337,051

(22) PCT Filed: Sep. 22, 2017

(86) PCT No.: PCT/EP2017/074040

§ 371 (c)(1),
(2) Date: Mar. 27, 2019

(87) PCT Pub. No.: WO2018/060080

PCT Pub. Date: Apr. 5, 2018

(65) Prior Publication Data

US 2020/0030867 A1 Jan. 30, 2020

(30) Foreign Application Priority Data

Sep. 29, 2016 (DE) ..... 10 2016 118 418.7

(51) Int. Cl.
*B21D 22/20* (2006.01)
*B21D 22/30* (2006.01)

(52) U.S. Cl.
CPC ..... *B21D 22/30* (2013.01)

(58) Field of Classification Search
CPC ..... B21D 22/20; B21D 22/201; B21D 22/21; B21D 22/22; B21D 22/26; B21D 22/30; B21D 5/01; B21D 22/02; B21D 24/005
See application file for complete search history.

(56) References Cited

U.S. PATENT DOCUMENTS 3,951,296 A * 4/1976 Swanson ..... B21D 22/30 220/669
4,225,553 A 9/1980 Hirota et al.
(Continued)

FOREIGN PATENT DOCUMENTS

CN 1202938 A 12/1998
CN 101758148 A 6/2010
(Continued)

OTHER PUBLICATIONS

Korean Publication; KR 2004061729 A; Kim; Jul. 7, 2004.*
"How to Prevent Wrinkling During Deep Drawing", ThomasNet, 2010, pp. 1-3.

*Primary Examiner* — Edward T Tolan
(74) *Attorney, Agent, or Firm* — The Webb Law Firm

(57) ABSTRACT

A method for producing a formed component is disclosed. The method includes: preforming a workpiece to a preformed component having a base region, a wall region, and optionally a flange region, wherein a material quantity adaptation is set in the preformed component; and calibrating the preformed component to a finally formed component, at least in regions, having a base region, a wall region, and optionally a flange region, wherein compressing of the preformed component is performed at least in regions during the calibrating. The method provides a formed component wherein the dimensional accuracy is improved and, in particular, any spreading of the walls of U-shaped components or part-portions can be influenced in a targeted manner, so as to further improve the dimensional accuracy of the
(Continued)

formed component. The material quantity adaptation is set by way of a base-specific material quantity adaptation, a wall-specific material quantity adaptation, a radii-specific material quantity adaptation, and/or optionally a flange-specific material quantity adaptation. A formed component made by the method is also disclosed.

24 Claims, 4 Drawing Sheets

(56) References Cited

U.S. PATENT DOCUMENTS

| | | | | |
|---|---|---|---|---|
| 5,452,599 | A | 9/1995 | Daudi et al. | |
| 5,953,951 | A * | 9/1999 | Fujimoto | B21D 5/01 72/379.6 |
| 6,038,910 | A * | 3/2000 | McClung | B21D 22/26 72/348 |
| 8,240,184 | B2 | 8/2012 | Flehmig et al. | |
| 8,522,593 | B2 | 9/2013 | Flehmig et al. | |
| 10,065,229 | B2 | 9/2018 | Flehmig et al. | |
| 10,081,043 | B2 | 9/2018 | Flehmig et al. | |
| 10,220,427 | B2 * | 3/2019 | Yoshikawa | B21J 13/025 |
| 2004/0244459 | A1 | 12/2004 | Shiokawa | |
| 2005/0268685 | A1 | 12/2005 | Bolt et al. | |
| 2007/0125149 | A1 | 6/2007 | Yoshitome et al. | |
| 2008/0299352 | A1 | 12/2008 | Matsuda et al. | |
| 2010/0133724 | A1 | 6/2010 | Flehmig et al. | |
| 2011/0165431 | A1 | 7/2011 | Inoue et al. | |
| 2012/0018422 | A1 | 1/2012 | Bohner et al. | |
| 2012/0282482 | A1 | 11/2012 | Flehmig et al. | |
| 2014/0047891 | A1 * | 2/2014 | Flehmig | B21D 22/22 72/338 |
| 2014/0182349 | A1 | 7/2014 | Yonemura et al. | |
| 2015/0239029 | A1 * | 8/2015 | Yamamoto | B21D 24/04 72/372 |
| 2015/0360273 | A1 | 12/2015 | Lin et al. | |
| 2016/0375477 | A1 | 12/2016 | Tanaka et al. | |
| 2017/0225216 | A1 | 8/2017 | Flehmig et al. | |

FOREIGN PATENT DOCUMENTS

| | | | | |
|---|---|---|---|---|
| CN | 101888908 | A | 11/2010 | |
| CN | 102665956 | A | 9/2012 | |
| CN | 103619503 | A | 3/2014 | |
| CN | 102581126 | B | 10/2014 | |
| CN | 104959442 | A | 10/2015 | |
| CN | 105921639 | A | 9/2016 | |
| CN | 105792956 | B | 9/2017 | |
| DE | 69424512 | T2 | 10/2000 | |
| DE | 102008018656 | B3 | 3/2009 | |
| DE | 102007059251 | A1 | 6/2009 | |
| DE | 102008002736 | A1 | 12/2009 | |
| DE | 102008037612 | A1 | 6/2010 | |
| DE | 102009059197 | A1 | 6/2011 | |
| DE | 102010005263 | A1 | 7/2011 | |
| DE | 102013103612 | A1 | 10/2014 | |
| DE | 102013103751 | A1 | 10/2014 | |
| EP | 0873437 | B1 | 5/2002 | |
| EP | 1792671 | A1 | 6/2007 | |
| EP | 2217393 | B1 | 3/2012 | |
| JP | H06218442 | A | 8/1994 | |
| JP | H07314068 | A | 12/1995 | |
| JP | 08-309469 | A * | 11/1996 | B21D 22/26 |
| JP | 8309469 | A | 11/1996 | |
| JP | 2004202541 | A | 7/2004 | |
| JP | 2010120058 | A | 6/2010 | |
| JP | 2010120059 | A | 6/2010 | |
| WO | 9724477 | A | 7/1997 | |
| WO | 0245882 | A1 | 6/2002 | |
| WO | 2009071437 | A1 | 6/2009 | |
| WO | 2011083008 | A1 | 7/2011 | |
| WO | 2014049070 | A1 | 4/2014 | |

* cited by examiner

METHOD FOR PRODUCING A FORMED COMPONENT HAVING A DIMENSIONALLY ACCURATE WALL REGION

CROSS REFERENCE TO RELATED APPLICATIONS

This application is the United States national phase of International Application No. PCT/EP2017/074040 filed Sep. 22, 2017, and claims priority to German Patent Application No. 10 2016 118 418.7 filed Sep. 29, 2016, the disclosures of which are hereby incorporated by reference in their entirety.

BACKGROUND OF THE INVENTION

Field of the Invention

The invention relates to a method for producing a formed component, the method comprising: preforming a workpiece to a preformed component having a base region, a wall region, and optionally a flange region, wherein a material quantity adaptation is set in the preformed component; and calibrating the preformed component to an at least in regions finally formed component having a base region, a wall region, and optionally a flange region, wherein compressing of the preformed component is performed at least in regions during the calibrating. The invention furthermore relates to a formed component.

DESCRIPTION OF RELATED ART

In the production of components, in particular open profiled components that are U-shaped in the cross section, for example by means of deep drawing, a deflection between the base and the walls, or between the walls and the optionally present flanges of the component, respectively, arises in most instances after the retrieval of the component from the tool by virtue of the inevitable elastic spring-back. This shape change is additionally superimposed by a curvature of the walls, said curvature typically being outwardly directed. The ends of the component are consequently spread. This effect arises to a greater extent in the case of high-strength steel materials and minor sheet-metal thicknesses, or else in the forming of other metallic material such as, for example, aluminum.

In order for the above to be countered, a preformed component (preform) having a uniform material quantity adaptation in the form of a material addition or a compression addition is produced, for example, by means of a deep-drawing step or other forming methods or a combination thereof such as "embossing and raising" or bending, edge-bending, etc. The intense and indifferent spring-back of the component arising herein is subsequently re-aligned by way of a calibrating step by means of compressive-stress superimposition, such that an at least in regions finally formed and dimensionally accurate component can be created.

For example, when deep-drawing using a spaced-apart blank holder is used for preforming, the spring-back effects are in most instances concentrated on the wall regions and the radii regions (drawing radii and base radii). The walls in this instance mostly curve outward, this being due to said walls as from a specific length having to pass at least two bending procedures: one bending procedure about the drawing radius when drawing the workpiece into the tool, and the subsequent reverse bending procedure in the straight wall part of the tool. By contrast, only a single bending procedure is performed in the case of the base radii.

In detail, in the production of the components by a single bending procedure a compression region is created on the internal side of the incorporated curvature, and a tension region is created on the external side. In the case of a double bending procedure with opposing actions, the conditions are indeed reversed under a further solidification, but the stress differences remain, albeit to a reduced extent. The non-homogenous elastic stress portions are then released as the component is retrieved from the tool and deform the component to greater or lesser extent, this inter alia leading to the component walls being bent open and to an undesirable curvature of said component walls.

It has been known for some time that the unintentional elastic spring-back is created above all in that the affected regions are imparted insufficient stretching. Targeted stretching measures or drawbeads can only reduce the effect and often require a technical modification of the plant. Stretching measures of this type also lead to an additional elongation of the material which in turn can lead to cracks.

The method described, by virtue of the inclusion of preferably all surface areas of the component in the process, is better capable than, for example conventional deep-drawing, of re-aligning the inherent stresses of the component. Nevertheless, a small residual spring-back remains, depending on the material and the compression situation. This is mainly the result of an enlargement of the base-and-flange bending radius and of the base-and-flange bending angle.

SUMMARY OF THE INVENTION

Against this background, the invention is based on the object of providing a method and a component, wherein the dimensional accuracy is furthermore improved and in particular any spreading of the walls of U-shaped components or portions of parts can be influenced in a targeted manner so as to further improve the dimensional accuracy of the components.

The object according to a first teaching in the case of generic method is achieved in that the material quantity adaptation is set by way of a base-specific material quantity adaptation, a wall-specific material quantity adaptation, a radii-specific material quantity adaptation, and/or optionally a flange-specific material quantity adaptation.

According to the present teaching it has been recognized that an improved dimensional accuracy in particular of the wall region of the component can be achieved when the material quantity adaptation provided in the preformed component is set specifically for the base region, the wall region, a radii region, and/or optionally the flange region. It has been demonstrated in particular that an influence can be exerted on the wall opening angle and on the wall curvature radius by way of a material quantity adaptation in the preformed component which is set specifically for the base region, the wall region, a radii region and/or flange region. The wall opening angle herein is understood to be the angle between the wall and the base of the component. On account thereof, undesirable deformations in the at least in regions finally formed component can be counteracted, and an improved dimensional accuracy in the at least in regions finally formed component can be achieved. A comparable possibility of influencing the wall opening angle in such a manner in the case of methods in the prior art has not been known to date. A material quantity adaptation is typically stated as a relative indication in percent (%) in comparison to the material quantity that is actually predefined by the desired final shape in the desired (part-)portion.

A radii region is in particular to be understood a curved transition region between the base region and the wall region, or between the wall region and the flange region (if present).

A material quantity adaptation is in particular understood to be that more or less material is provided in the respective region than is predefined by the geometry of the at least in portions finally formed component, for example. Region-specific material quantity adaptation herein is in particular understood to be that the material quantity in the individually considered region is individually set.

For example, the wall-specific, base-specific, radii-specific, and/or optionally flange-specific material quantity adaptation is predetermined. For example, a desired wall-specific, base-specific, radii-specific, and/or optionally flange-specific material quantity adaptation is ascertained by means of a simulation, for example by way of a finite-element method.

The setting of a material quantity adaptation is preferably performed in that the workpiece is adapted. For example, more or less material in the respective region is already provided in the workpiece, or the geometry of the workpiece leads to a respective material quantity adaptation being set in the preformed component.

The workpiece is, for example, a substantially planar blank, for example a metal sheet. The workpiece is preferably produced from a steel material. Alternatively, aluminum materials or other forming-capable metals can also be used. The formed component is accordingly preferably a sheet-metal component.

The preforming herein can be established in one or a plurality of steps by means of shape-imparting methods that can be combined in an arbitrary manner. The preforming can comprise a deep-drawing-type shaping step, for example. In particular, multi-staged shaping, comprising for example embossing of the base to be established and raising the walls to be established, or optionally folding back of the flanges to be established, respectively, can also be performed. In particular, single-stage or multi-stage shaping procedures by, for example, edge-bending and bending, for example by U-forging, can be also be used. Any arbitrary combinations of edge-bending and/or embossing are also conceivable. The path leading to the preformed component can accordingly be travelled in an individual manner. The preformed component obtained by the preforming can in particular be considered to be a component that is close to the final shape and which corresponds as well as possible to the envisaged geometry of the completed part, while taking into account given boundary parameters such as the rebounding and primary-forming capability of the material used.

Calibrating can in particular be understood to be complete forming or final forming of the preformed component, this being achievable, for example, by way of one or a plurality of pressing procedures. However, it is possible that the at least in regions completely formed component can be subjected to even further processing steps that modify the component, such as an incorporation of attachment holes or a trimming procedure, or else to localized post-forming or final forming. However, the aspiration is to design the calibrating mold in such a manner that no further shaping steps are required.

The preforming and calibrating described are preferably performed successively. Moreover, the calibrating can be carried out only in terms of some regions or in terms of the entire component.

According to one preferred design embodiment of the method according to the invention the base-specific material quantity adaptation, the wall-specific material quantity adaptation, the radii-specific material adaptation, and/or optionally the flange-specific material quantity adaptation are/is a material addition. In the case of a material quantity adaptation in the form of a material addition, additional material or excess material (as compared to the final shape) is made available, said material in the calibrating procedure leading to a targeted compression and in particular being able to lead to a material flow and/or to a solidification. To this extent, the material addition is also referred to as a compression addition. For example, a material addition of at least 1%, at least 2%, or at least 3% is provided in the base region, the wall region, the radii region, and/or the flange region. The base-specific material quantity adaptation as well as the wall-specific material quantity adaptation, the radii-specific material adaptation, and optionally the flange-specific material quantity adaptation preferably are a material addition. However, a material quantity adaptation can also in particular be configured locally as a material reduction. Herein, less material than as predefined by the final shape is made available. For example, a material reduction of at least −1%, at least −2%, or at least −3% is provided in the base region, in the wall region, in the radii region, and/or optionally in the flange region. In absolute terms, and in order for a calibrating effect to be ensured, the preformed component in relation to the finally formed component has a positive material excess.

According to one particularly preferred design embodiment of the method according to the invention the base-specific material quantity adaptation, the wall-specific material quantity adaptation, the radii-specific material adaptation, and/or optionally the flange-specific material quantity adaptation differ from one another. Different material adaptations are understood to be that the percentage values relating to the base-specific material quantity adaptation, the wall-specific material quantity adaptation, the radii-specific material adaptation, or the flange-specific material quantity adaptation differ from one another. In other words, and a symmetrical or non-uniform material quantity adaptation is provided in terms of the base region, the wall region, the radii region, and/or optionally the flange region. It has been demonstrated that dissimilar material quantity adaptations lead to a material flow from one region to the other region during the compression when calibrating, and that in particular the wall opening angle and/or the wall curvature radius can be influenced on account thereof. As a result, particularly dimensionally accurate components can thus be provided.

In one example, the base-specific material quantity adaptation is +2% (material addition), and the wall-specific material quantity adaptation is +3% (material addition). In another example the base-specific material quantity adaptation is +2% (material addition), and the wall-specific material quantity adaptation is −2% (material reduction). In total, the material addition across the entire cross section considered is however so large that the cross section is compressed and thus calibrated at least in regions.

According to one preferred design embodiment of the method according to the invention the base-specific material quantity adaptation and the wall-specific material quantity adaptation are set in such a manner that a material flow from the wall region into the base region and/or from the base region into the wall region is performed during the calibrating. According to one further design embodiment a flange region is present, and the wall-specific material quantity adaptation and the flange-specific material quantity adaptation are set in such a manner that a material flow from the wall region into the flange region and/or from the flange region into the wall region is performed during the calibrating. As has already been explained, a material flow of this type can in particular be achieved by dissimilar material quantity adaptations in the base region, in the wall region, and/or optionally in the flange region of the preformed component, and can advantageously be used for a targeted adaptation of the wall opening angle and/or of the wall curvature radius, such that a high dimensional accuracy can be achieved as a result. It has been demonstrated that a material flow from the wall region into the base region as well as from the base region into the wall region and/or, if a flange region is present, a material flow from the wall region into the flange region as well as from the flange region into the wall region leads to said effect.

According to one preferred design embodiment of the method according to the invention at least two material quantity adaptations from the group of the base-specific material quantity adaptation, the wall-specific material quantity adaptation, the radii-specific material quantity adaptation, and/or optionally the flange-specific material quantity adaptation are a material addition, wherein at least one material addition is larger than at least one other material addition. For example, the base-specific material addition is larger than the wall-specific material addition and/or optionally the flange-specific material addition, or the wall-specific material addition is larger than the base-specific material addition and/or optionally the flange-specific material addition. This is understood to mean that the respective relative material addition is to be larger in % terms. In this way, a high compression-related solidification can be achieved, and a material flow between the base region, the wall region, the radii region, and/or optionally the flange region can moreover be provoked during the calibrating, such that the wall opening angle and/or the wall curvature radius can be influenced in the desired manner.

According to one preferred design embodiment of the method according to the invention at least two material quantity adaptations from the group of the wall-specific material quantity adaptation, the base-specific material quantity adaptation, the radii-specific material quantity adaptation, and/or optionally the flange-specific material quantity adaptation differ from one another by at least 0.2 percentage points, in particular by at least 0.5 percentage points, preferably by at least 1 percentage point, furthermore preferably by at least 2 percentage points. It has been demonstrated the effect on the wall opening angle and/or the wall curvature radius can be achieved in a process-reliable manner for a multiplicity of components by way of this minimum difference in the material quantity adaptations. For example, if the base-specific material addition is +2% and the wall-specific material addition is +3%, the difference is 1 percentage point. For example, if the base-specific material addition is +2% and the wall-specific material reduction is −2%, the difference is 4 percentage points.

According to one preferred design embodiment of the method according to the invention the base-specific material quantity adaptation, the wall-specific material quantity adaptation, the radii-specific material quantity adaptation, and/or optionally the flange-specific material quantity adaptation are set in such a manner that the wall opening angle and/or the wall curvature radius of the at least in regions finally formed component are/is influenced in a targeted manner. In other words, the base-specific material quantity adaptation, the wall-specific material quantity adaptation, the radii-specific material quantity adaptation, and/or optionally the flange-specific material quantity adaptation are set as a function of a desired wall opening angle and/or of a desired wall curvature radius. For example, the required material quantity adaptations are first determined in the context of a simulation or of experiments and are then set in a corresponding manner on the preformed component.

According to one preferred design embodiment of the method according to the invention the difference between at least two material quantity adaptations from the group of the base-specific material quantity adaptation, the wall-specific material quantity adaptation, the radii-specific material quantity adaptation, and/or optionally the flange-specific material quantity adaptation is set to so as to be sufficiently large such that any spreading of the wall region of the at least in regions finally formed component is substantially avoided. This design embodiment of the method is based on the concept that an increase of the difference of the material quantity adaptations, in particular in the base region and in the wall region, leads to a reduction of the wall opening angle. For example, the difference is at least 0.2 percentage points, in particular at least 0.5 percentage points, preferably at least 1 percentage point, furthermore preferably at least 2 percentage points. The required difference herein can be a function of the individual case and be influenced by the geometry of the respective component to be produced and/or by the material. As has already been explained, the respective required material quantity adaptation can however be ascertained based on experiments or by simulations. Any spreading is in particular substantially avoided when the wall opening angle toward the top deviates from the nominal angle by less than 2', preferably less than 1', particularly preferably less than 0.5'.

According to one preferred design embodiment of the method according to the invention the difference between at least two material adaptations from the group of the base-specific material quantity adaptation, the wall-specific material quantity adaptation, the radii-specific material quantity adaptation, and/or optionally the flange-specific material quantity adaptation is set so as to be sufficiently minor such that any inward folding of the wall region of the at least in regions finally formed component is substantially avoided. This design embodiment of the method is based on the concept that a reduction of the difference of the material quantity adaptations, in particular in the base region and in the wall region, leads to an increase of the wall opening angle. For example, the difference is at most 5 percentage points, preferably at most 4 percentage points, furthermore preferably at most 3 percentage points. Any inward folding is substantially avoided in particular when the wall opening angle toward the bottom deviates from the nominal angle by less than 2', preferably less than 1', particularly preferably less than 0.5'.

According to one preferred design embodiment of the method according to the invention the base-specific material quantity adaptation, the wall-specific material quantity adaptation, the radii-specific material quantity adaptation, and/or optionally the flange-specific material quantity adaptation are/is a material addition and are/is set so as to be sufficient the large such that any spreading of the wall region of the at least in regions finally formed component is substantially avoided, for example so as to be larger than +0.5%, preferably larger than +1%.

Moreover, in the case of a wall-specific and/or base-specific material addition, and/or optionally a flange-specific material quantity adaptation, said material addition or material quantity adaptation, respectively, is preferably configured so as to be sufficiently minor, for example so as to be less than +5%, preferably less than +4%, furthermore preferably less than +3%, so as to substantially avoid any inward folding of the wall region.

This design embodiment of the method is based on the concept that an enlarged wall-specific, base-specific, radii-specific, and/or optionally flange-specific material addition leads to a reduction of the wall opening angle.

According to one preferred design embodiment of the method according to the invention the wall-specific material quantity adaptation is a material addition and is set so as to be sufficiently large such that any excessive wall curvature of the wall region of the at least in regions finally formed component is substantially avoided. This design embodiment of the method is based on the concept that an increase of a wall-specific material addition typically leads to a reduction of the wall curvature, or to an enlargement of the wall curvature radius, respectively. For example, the wall-specific material addition is at least +0.5%, preferably at least +1%, furthermore preferably at least +2%. An excessive wall curvature is substantially avoided in particular when the wall curvature radius is larger than $10^3$ mm, preferably larger than $10^4$ mm, furthermore preferably larger than $10^5$ mm.

According to one preferred design embodiment of the method according to the invention the formed component has a U-shaped cross section. For example, the formed component is a U-shaped profile or a cup-shaped or tub-shaped component. Caused by the geometry, the issue of a particularly intense spring-back in the wall region after the forming exists above all in the case of components of this type. This issue can be avoided or at least minimized by the method according to the invention. The formed component is, for example, a non-flanged or flanged component. In the latter case, the component, apart from the base region and the wall region, also has a flange region. The wall region preferably runs so as to be oblique or substantially perpendicular to the base region and/or to the flange region.

According to one preferred design embodiment of the method according to the invention the formed component is made from a steel material. The steel material is preferably an at least high-strength steel material. Steel materials of this type in the case of classic forming methods have a particularly strong spring-back. The method according to the invention therefore enables a high dimensional accuracy to be set even in the case of steel materials having a material-related strong spring-back.

According to one further preferred design embodiment of the method according to the invention the formed component is made from an aluminum material. The aluminum material is preferably an at least high-strength aluminum material. Aluminum materials of this type in the case of classic forming methods have a particularly strong spring-back. The method according to the invention therefore enables a high dimensional accuracy to be set even in the case of aluminum materials having a material-related strong spring-back.

According to a second teaching, the object mentioned at the outset in the case of a formed component having a base region, a wall region, and optionally a flange region, is achieved in that the component is produced by a method according to the invention. As opposed to known formed components from the prior art, the components according to the invention by virtue of the compressing by way of the material quantity adaptation described have an advantageous stress distribution such that a high dimensional accuracy can be achieved.

BRIEF DESCRIPTION OF THE DRAWINGS

The invention is to be explained in more detail hereunder by means of exemplary embodiments in conjunction with the drawing. In the drawing

DESCRIPTION OF THE INVENTION

FIGS. 1, 2 show in each case schematic cross-sectional illustrations of a wall region 2, 2' and of a base region 4, 4' of a component 1, 1' for visualizing the effects of an exemplary embodiment of the method on the component 1, 1'.

Figure 1B:
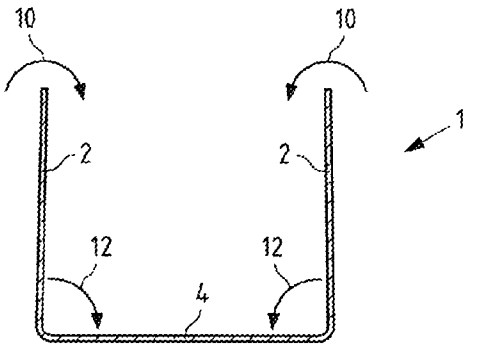
FIGS. 1, 2 show in each case schematic cross-sectional illustrations of a wall region and of a base region of a component for visualizing the effects of an exemplary embodiment of the method on the component.
Figure 1A:
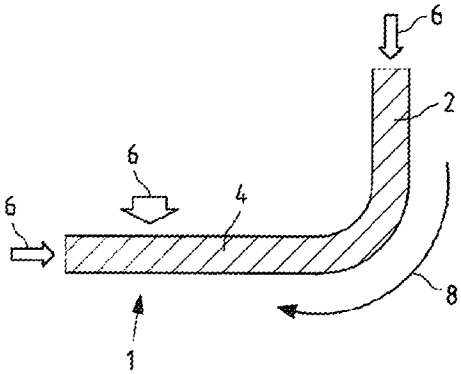

The component 1 in FIG. 1*a* has a base-specific material quantity adaptation in the form of a material addition or a compression addition of +2%, and a wall-specific material quantity adaptation in the form of a material addition or compression addition of +3%. On account of the compressing during the calibrating, illustrated by the arrows 6, a material flow is performed from the wall region into the base region, as is visualized by the arrow 8. As has been ascertained by simulations and is illustrated in FIG. 1*b*, this leads to the wall opening angle, or the mutual distance of the wall ends, respectively, being able to be reduced (arrows 10, 12). On account thereof, CAD-true base radii can be achieved, and an outward spring-back of the wall regions 2 can be counteracted such that the dimensional accuracy can be improved.

Figure 2B:
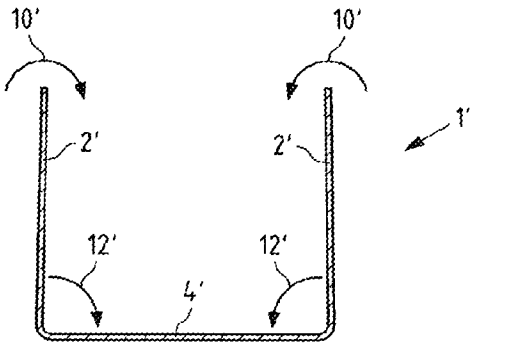
Figure 2A:
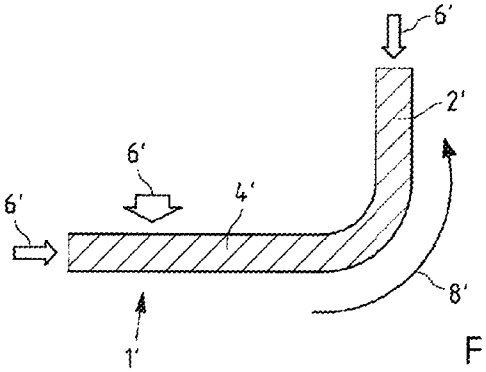

The component 1' in FIG. 2*a* has a base-specific material quantity adaptation in the form of a material addition or compression addition of +2%, and a wall-specific material quantity adaptation in the form of a material reduction of −2%. On account of the compression during the calibrating, illustrated by the arrows 6', a material flow is performed from the base region 4' into the wall region 2', as is visualized by the arrow 8'. As has been ascertained by simulations and is illustrated in FIG. 2*b*, this also in this case leads to the wall opening angle, or the mutual distance of the wall ends, respectively, being able to be reduced (arrows 10', 12'). CAD-true base radii can thus also be achieved here, and an outward spring-back of the wall regions 2' can be counteracted such that the dimensional accuracy can be improved.

Figure 3:
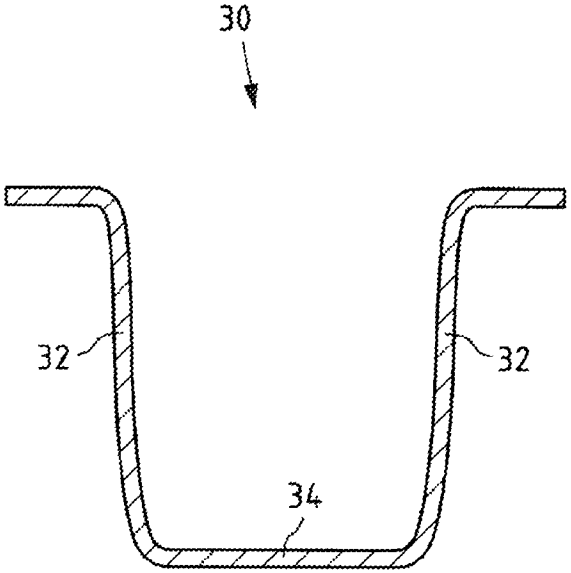
Fig.3 Prior art
FIG. 3 shows a schematic cross-sectional illustration of a component according to the prior art.

FIG. 3 shows a schematic cross-sectional illustration of a flanged component 30 according to the prior art. The component 30 is produced by conventional deep drawing. The component 30, by virtue of the transition from the base region 34 to the wall region 32, exhibits spreading of the walls. Moreover, the wall region 32 has a residual curvature.

Figure 4:
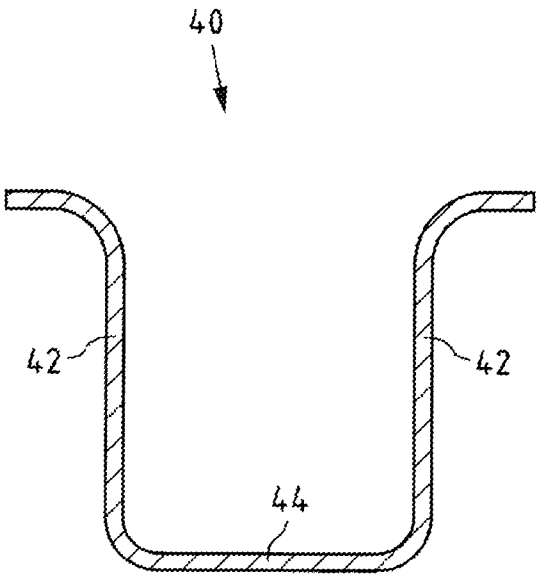
FIG. 4 shows a schematic cross-sectional illustration of a component which has been produced according to an exemplary embodiment of the method according to the invention.

FIG. 4 shows a schematic cross-sectional illustration of a flanged component 40 which has been produced according to an exemplary embodiment of the method according to the invention. A base-specific material addition and a wall-specific material addition herein were distributed in a non-uniform manner. It can be seen that the component 40, as opposed to the component 30, by virtue of the transition from the base region 44 to the wall region 42 does not exhibit any spreading of the walls. Moreover, the wall region 42 does not have any residual curvature.

Figure 5:
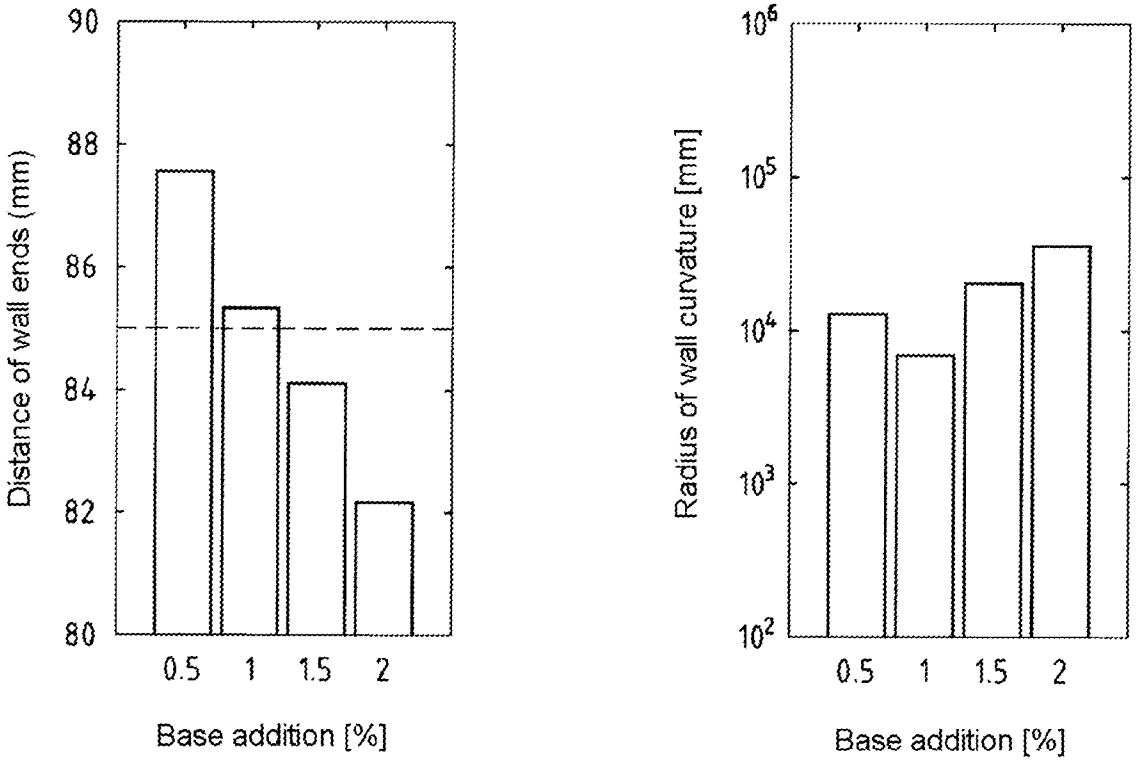
FIG. 5 shows test results for the wall end distance and the wall curvature radius as a function of the base-specific material addition after the calibrating.

FIG. 5 shows test results for the wall end distance, respectively the component end distance, and the wall curvature radius as a function of the base-specific material addition ("base addition") after the calibrating.

The base-specific material additions or compression additions have been implemented in the form of two uniform corrugations from segment arches of a circle having identical radii in the base region.

In FIG. 5, on the left the distance of the wall ends in mm is plotted over the base addition in %. The dashed line herein represents the nominal width of the wall ends. By contrast, on the right the radius of the wall curvature in mm is plotted over the base addition in %. Base additions of 0.5%, 1.0%, 1.5%, and 2.0% were chosen herein. The wall-specific material addition was at all times 3.0%.

Figure 6:
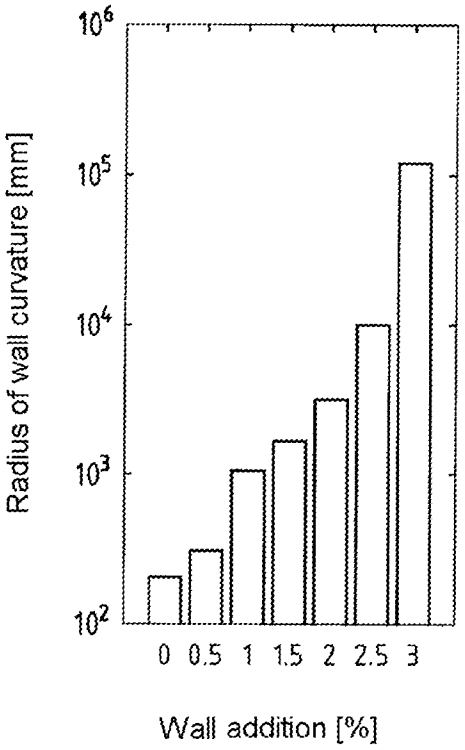
FIG. 6 shows test results for the wall end distance and the wall curvature radius as a function of the wall-specific material addition after the calibrating.
Figure 6:
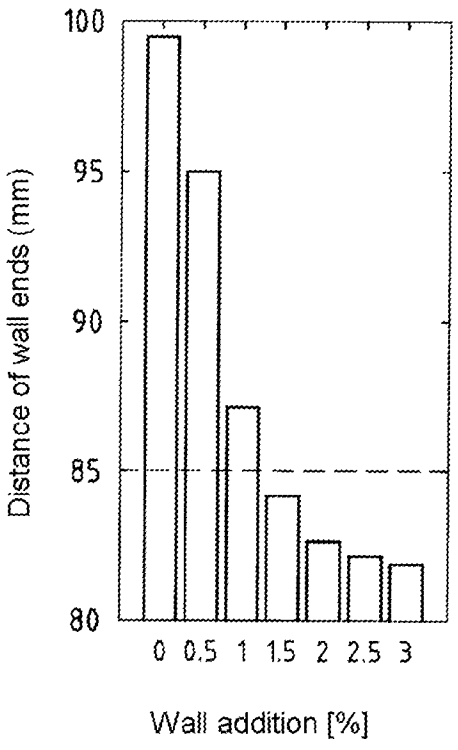

FIG. 6 shows test results for the wall end distance and the wall curvature radius as a function of the wall-specific material addition ("wall addition") after the calibrating.

The wall-specific material additions or compression additions here have been implemented in the form of three uniform, or tangentially consistent, respectively, corrugations from segment arches of a circle having identical radii in the base region.

On the left the distance of the wall ends in mm is plotted over the wall addition in %. The dashed line herein represents the nominal width of the wall ends. By contrast, on the right the radius of the wall curvature in mm is plotted over the wall addition in %. Wall additions of 0%, 0.5%, 1.0%, 1.5%, 2.0%, 2.5%, and 3.0% were chosen herein. The base-specific material addition was at all times 2.0%.

It can be seen that by splitting a general material addition into a base-specific material addition and a wall-specific material addition the wall end distance (or the wall opening angle, respectively) and the wall curvature radius can be set. It can be seen that the wall curvature can be reduced, or the wall curvature radius can be increased, respectively, by increasing the wall-specific material addition, since said wall curvature radius is primarily influenced by the wall-specific material addition (FIG. 6 on the right, as compared to FIG. 5 on the right). The wall-specific material addition can thus be set so as to be sufficiently large such that any excessive wall curvature of the walls of the at least in regions finally formed component can be substantially avoided.

It can moreover be seen that the base-specific and/or wall-specific material addition should be set so as to be sufficiently large such that any spreading of the walls of the at least in regions finally formed component is substantially avoided, however should also be configured so as to be sufficiently minor in order for any inward folding to be substantially avoided (cf. FIG. 5 on the left, FIG. 6 on the left).

The exemplary method and the exemplary device here have been explained in more detail by means of a non-flanged component. Flanged components are subject to an analogous procedure.

The invention claimed is:

1. A method for producing a formed component, the method comprising the steps of:

preforming a workpiece into a preformed component having a base region, a wall region, and a flange region, wherein a material quantity adaptation is set in the preformed component; and calibrating the preformed component, at least in regions, to a finally formed component having the base region, the wall region, and the flange region, wherein compressing of the preformed component is performed at least in regions during the calibrating, wherein the material quantity adaptation is set by way of a material quantity adaptation of the base region, the wall region, a radius region, and/or the flange region, wherein an amount in percent of a material quantity adaptation of the base region is a percentage of a final material quantity of a base region of the component, an amount in percent of a material quantity adaptation of the wall region is a percentage of a final material quantity of a wall region of the component, an amount in percent of a material quantity adaptation of the radius region is a percentage of a final material quantity of a radius region of the component, and an amount in percent of a material quantity adaptation of the flange region is a percentage of a final material quantity of an flange region of the component, and at least two of the amounts selected from the amount of the material quantity adaptation of the base region, the amount of the material quantity adaptation of the wall region, the amount of the material quantity adaptation of the radius region, and the amount of the material quantity adaptation of the flange region differ from one another, wherein the amount of the material quantity adaptation of the base region and the amount of the material quantity adaptation of the wall region are set such that a material flow from the wall region in a direction of the base region and/or a material flow from the base region in a direction of the wall region is performed during the calibrating, and/or wherein the amount of the material quantity adaptation of the wall region and the amount of the material quantity adaptation of the flange region are set such that a material flow from the wall region in a direction of the flange region and/or a material flow from the flange region in a direction of the wall region is performed during the calibrating, and wherein the amounts of at least two material quantity adaptations selected from the group consisting of the material quantity adaptation of the base region, the material quantity adaptation of the wall region, the material quantity adaptation of the radius region, and the material quantity adaptation of the flange region differ from one another by at least 0.2 percentage points.

2. The method as claimed in claim 1, wherein a material quantity adaptation of the base region, the wall region, the radius region, and/or the flange region is a material addition.

3. The method as claimed in claim 1, wherein at least two material quantity adaptations selected from the group consisting of the base-specific material quantity adaptation of the base region, the material quantity adaptation of the wall region, the material quantity adaptation of the radius region, and the material quantity adaptation of the flange region are a material addition, and at least one material addition is larger than at least one other material addition.

4. The method as claimed in claim 1, wherein at least one selected from the material quantity adaptation of the base region, the material quantity adaptation of the wall region, the material quantity adaptation of the radius region, and the material quantity adaptation of the flange region is set in such a manner that a wall opening angle and/or a wall curvature radius of the finally formed component, at least in regions, is influenced in a targeted manner.

5. The method as claimed in claim 1, wherein a difference between the amounts of at least two material quantity adaptations selected from the group of the material quantity adaptation of the base region, the material quantity adaptation of the wall region, the material quantity adaptation of the radius region, and the material quantity adaptation of the flange region is set so as to be sufficiently large such that any spreading of the wall region of the finally formed component, at least in regions, is substantially avoided.

6. The method as claimed in claim 1, wherein a difference between the amounts of at least two material quantity adaptations selected from the group of the material quantity adaptation of the base region, the material quantity adaptation of the wall region, the material quantity adaptation of the radius region, and the material quantity adaptation of the flange region is set so as to be sufficiently minor such that any inward folding of the wall region of the finally formed component, at least in regions, is substantially avoided.

7. The method as claimed in claim 1, wherein at least one material quality adaptation selected from the group of the material quantity adaptation of the base region, the material quantity adaptation of the wall region, the material quantity adaptation of the radius region, and the material quantity adaptation of the flange region is a material addition and is set so as to be sufficiently large such that any spreading of the wall region of the finally formed component, at least in regions, is substantially avoided.

8. The method as claimed in claim 1, wherein the material quantity adaptation of the wall region is a material addition and is set so as to be sufficiently large that any excessive wall curvature of the wall region of the component at least in portions of the finally formed component is substantially avoided.

9. The method as claimed in claim 1, wherein the formed component has a cup-shaped cross section.

10. The method as claimed in claim 1, wherein the formed component is made from one of a steel material and an aluminum material.

11. A formed component having a base region, a wall region, and a flange region, produced by the method as claimed in claim 1.

12. The method as claimed in claim 1, wherein the amounts of at least two material quantity adaptations selected from the group of the material quantity adaptation of the base region, the material quantity adaptation of the wall region, the material quantity adaptation of the radius region, and the material quantity adaptation of the flange region differ by at least 0.5 percentage points.

13. The method as claimed in claim 1, wherein the amounts of at least two material quantity adaptations selected from the group of the material quantity adaptation of the base region, the material quantity adaptation of the wall region, the material quantity adaptation of the radius region, and the material quantity adaptation of the flange region differ by at least 2 percentage points.

14. A method for producing a formed component, the method comprising the steps of:

preforming a workpiece into a preformed component having a base region and a wall region, wherein a material quantity adaptation is set in the preformed component; and calibrating the preformed component, at least in regions, to a finally formed component having the base region and the wall region, wherein compressing of the preformed component is performed at least in regions during the calibrating, wherein the material quantity adaptation is set by way of a material quantity adaptation of the base region, the wall region, and/or a radius region, an amount in percent of a material quantity adaptation of the base region is a percentage of a final material quantity of a base region of the component, an amount in percent of a material quantity adaptation of the wall region is a percentage of a final material quantity of a wall region of the component, and an amount in percent of a material quantity adaptation of the radius region is a percentage of a final material quantity of a radius region of the component, and at least two of the amounts selected from the amount of the material quantity adaptation of the base region, the amount of the material quantity adaptation of the wall region, and the amount of the material quantity adaptation of the radius region differ from one another, the amount of the material quantity adaptation of the base region and the amount of the material quantity adaptation of the wall region are set such that a material flow from the wall region in a direction of the base region and/or from the base region in a direction of the wall region is performed during the calibrating, and the amounts of at least two material quantity adaptations selected from the group consisting of the material quantity adaptation of the base region, the material quantity adaptation of the wall region, and the material quantity adaptation of the radius region differ from one another by at least 0.2 percentage points.

15. The method as claimed in claim 14, wherein a material quantity adaptation of the base region, the wall region, and/or the radius region is a material addition.

16. The method as claimed in claim 14, wherein at least two material quantity adaptations selected from the group consisting of the base-specific material quantity adaptation of the base region, the material quantity adaptation of the wall region, and the material quantity adaptation of the radius region are a material addition, wherein at least one material addition is larger than at least one other material addition.

17. The method as claimed in claim 14, wherein at least one selected from the material quantity adaptation of the base region, the material quantity adaptation of the wall region, and the material quantity adaptation of the radius region is set in such a manner that a wall opening angle and/or a wall curvature radius of the finally formed component, at least in regions, is influenced in a targeted manner.

18. The method as claimed in claim 14, wherein a difference between the amounts of at least two material quantity adaptations selected from the group of the material quantity adaptation of the base region, the material quantity adaptation of the wall region, and the material quantity adaptation of the radius region is set so as to be sufficiently large such that any spreading of the wall region of the finally formed component, at least in regions, is substantially avoided.

19. The method as claimed in claim 14, wherein a difference between the amounts of at least two material quantity adaptations selected from the group of the material quantity adaptation of the base region, the material quantity adaptation of the wall region, and the material quantity adaptation of the radius region is set so as to be sufficiently minor such that any inward folding of the wall region of the finally formed component, at least in regions, is substantially avoided.

20. The method as claimed in claim 14, wherein at least one material quality adaptation selected from the group of the material quantity adaptation of the base region, the material quantity adaptation of the wall region, and the material quantity adaptation of the radius region is set so as to be sufficiently large such that any spreading of the wall region of the finally formed component, at least in regions, is substantially avoided.

21. The method as claimed in claim 14, wherein the material quantity adaptation of the wall region is a material addition and is set so as to be sufficiently large that any excessive wall curvature of the wall region of the component at least in portions of the finally formed component is substantially avoided.

22. The method as claimed in claim 14, wherein the formed component has a cup-shaped cross section.

23. The method as claimed in claim 14, wherein the formed component is made from one of a steel material and an aluminum material.

24. A formed component having a base region and a wall region, produced by the method as claimed in claim 14.

* * * * *